US011874073B2

(12) United States Patent
Huang et al.

(10) Patent No.: US 11,874,073 B2
(45) Date of Patent: Jan. 16, 2024

(54) RADIATIVE COOLING STRUCTURE WITH ENHANCED SELECTIVE INFRARED EMISSION

(71) Applicant: The Hong Kong University of Science and Technology, Hong Kong (CN)

(72) Inventors: Baoling Huang, Hong Kong (CN); Chongjia Lin, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 475 days.

(21) Appl. No.: 17/301,301

(22) Filed: Mar. 31, 2021

(65) Prior Publication Data

US 2021/0318081 A1 Oct. 14, 2021

Related U.S. Application Data

(60) Provisional application No. 63/100,941, filed on Apr. 9, 2020.

(51) Int. Cl.
*F28F 21/04* (2006.01)

(52) U.S. Cl.
CPC ..... *F28F 21/04* (2013.01)

(58) Field of Classification Search
None
See application file for complete search history.

(56) References Cited

U.S. PATENT DOCUMENTS

| | | | |
|---|---|---|---|
| 4,586,350 | A | 5/1986 | Berdahl |
| 5,405,680 | A | 4/1995 | Chang et al. |
| 7,503,971 | B2 | 3/2009 | Wojtysiak et al. |
| 9,709,349 | B2 | 7/2017 | Raman et al. |
| 9,927,188 | B2 | 3/2018 | Liu et al. |
| 10,060,686 | B2 | 8/2018 | Liu et al. |
| 10,088,251 | B2 | 10/2018 | Raman et al. |
| 10,323,151 | B2 | 6/2019 | Van Overmeere et al. |
| 10,386,097 | B2 | 8/2019 | Yu et al. |
| 2017/0248381 | A1 | 8/2017 | Yang et al. |
| 2017/0350121 | A1 | 12/2017 | Heltzel |
| 2019/0086164 | A1 | 3/2019 | Yang et al. |
| 2019/0257557 | A1 | 8/2019 | Yoshizawa et al. |

FOREIGN PATENT DOCUMENTS

| | | | | |
|---|---|---|---|---|
| AU | 2019236674 | B1 | 8/2020 | |
| CN | 209178283 | U | 7/2019 | |
| CN | 110972467 | A * | 4/2020 | ..... B32B 15/04 |
| WO | 2019/055789 | A1 | 3/2019 | |
| WO | 2019/113581 | A1 | 6/2019 | |
| WO | 2019/130199 | A1 | 7/2019 | |
| WO | 2019/163340 | A1 | 8/2019 | |

OTHER PUBLICATIONS

Xu, CN-110972467-A, Apr. 7, 2020 (machine translation) (Year: 2020).*
Raman et al.; Passive radiative cooling below ambient air temperature under direct sunlight; Nature; vol. 515; 2014; pp. 540-544.
Zhai et al.; Scalable-manufactured randomized glass-polymer hybrid metamaterial for daytime radiative cooling; Science; vol. 355; 2017; pp. 1062-1066.
Hossain et al.; A Metamaterial Emitter for Highly Efficient Radiative Cooling; Advanced Optical Materials; vol. 3, Issue 8; 2015; pp. 1047-1051.
Hossain et al.; Radiative Cooling: Principles, Progress, and Potentials; Advanced Science; vol. 3, Issue 7; 2016; Article No. 1500360.
Kou et al.; Daytime Radiative Cooling Using Near-Black Infrared Emitters; ACS Photonics; vol. 4; 2017; pp. 626-630.
Chen et al.; Radiative cooling to deep sub-freezing temperatures through a 24-h day-night cycle; Nature Communications; vol. 7; 2016; Article No. 13729.
Bao et al.; Double-layer nanoparticle-based coatings for efficient terrestrial radiative cooling; Solar Energy Materials and Solar Cells; vol. 168; 2017; pp. 78-84.
Huang et al.; Nanoparticle embedded double-layer coating for daytime radiative cooling; International Journal of Heat and Mass Transfer; vol. 104; 2017; pp. 890-896.
Vall et al.; Radiative cooling as low-grade energy source: A literature review; Renewable and Sustainable Energy Reviews; vol. 77; 2017; pp. 803-820.
Lu et al.; Cooling potentialandapplicationsprospectsofpassiveradiative cooling in buildings: The current state-of-the-art; Renewable and Sustainable Energy Reviews; vol. 65; 2016; pp. 1079-1097.
Mandal et al.; Hierarchically porous polymer coatings for highly efficient passive daytime radiative cooling; Science; vol. 362; 2018; pp. 315-319.
Hanif et al.; Potential energy savings by radiative cooling system for a building in tropical climate; Renewable and Sustainable Energy Reviews; vol. 32; 2014; pp. 642-650.

* cited by examiner

*Primary Examiner* — Cheng Yuan Huang
(74) *Attorney, Agent, or Firm* — S&F/WEHRW

(57) ABSTRACT

The present invention provides a radiative cooling structure that can be fabricated using solution-based processes and offer great IR-selectivity referring to low absorptivity within solar spectrum and high emissivity within the atmosphere transmission window (8-13 microns) for daytime radiative cooling. This structure includes a reflective layer, a ceramic IR-selectively emissive layer and a ceramic emission boosting layer, and the ceramic emission boosting layer is able to boost the overall emissivity of the radiative cooling structure within the atmosphere transmission windows and avoid infrared emission outside the atmosphere transmission window. The IR-selectivity contributes to larger temperature reduction, especially in high humidity area.

20 Claims, 9 Drawing Sheets
(2 of 9 Drawing Sheet(s) Filed in Color)

RADIATIVE COOLING STRUCTURE WITH ENHANCED SELECTIVE INFRARED EMISSION

CROSS-REFERENCE TO RELATED APPLICATIONS

This application claims the benefit of U.S. Provisional Patent Application No. 63/100,941, filed on Apr. 9, 2020, which is incorporated by reference herein in its entirety.

TECHNICAL FIELD

The present invention relates to a radiative cooling structure, and more particularly, to a radiative cooling structure with enhanced selective infrared emission and a method for fabricating the same.

BACKGROUND

Radiative cooling is a process that the thermal radiation emitted from a surface or object is stronger than the thermal energy absorbed from the ambient environment, which leads to heat dissipation or temperature reduction. Thus, this kind of surfaces or objects are called as radiative cooler. Most of thermal energy emitted from surfaces near room temperature are infrared radiation and some infrared radiation can be dissipated to outer space through the so-called "atmosphere windows", within which radiation can pass through the atmosphere with little absorption. Since outer space has extremely low temperature of about 3 K, only small amount of energy from the space is absorbed by a surface or object on the earth, while much stronger thermal power can be emitted through the atmosphere windows; therefore, net cooling can be achieved if other heat transfer to the emitter is weak. The net cooling power $P_{net}$ of a radiative cooler can be calculated as follows.

$$P_{net}(T_r, T_{amb}, T_{atm}) = P_r(T_r) - P_{atm}(T_{atm}) - P_{sun} - P_{cond}(T_r, T_{amb}) - P_{conv}(T_r, T_{amb})$$

where $T_r$, $T_{amb}$ and $T_{atm}$ are the effective temperatures of the radiative cooler surface, ambient and atmosphere, respectively. $P_{net}$ is the net cooling power. $P_r$ is the thermal power emitted by the cooler. $P_{atm}$ is the absorbed radiation power from atmosphere and $P_{sun}$ the absorbed solar irradiation while $P_{cond}$ and $P_{conv}$ are conductive and convective heat transfer rates between the cooler and ambient.

In order to improve the net cooling power, $P_r$ should be maximized while $P_{atm}$ and $P_{sun}$ are minimized. Based on this principle, coolers with high reflectivity for solar irradiation (0.3-2.5 μm) and high emissivity (absorption) for infrared (2.5-25 μm) have been developed.

However, atmospheric window with high transmission mainly exists within 8-13 μm, especially in high-humidity area. Strong emissivity in other infrared area would limit further temperature reduction. To maximize the cooling performance, a good radiative cooler should offer excellent IR selectivity, i.e., a high emissivity only for 8-13 μm and a high reflectivity in other wavelength region.

Over the past decade, a large number of researches on daytime radiative cooling have been conducted. Accordingly, great IR selectivity is essential to achieve a large temperature reduction, especially under high humidity. Although some coolers with good IR selectivity have been purposed, their structures are often too complicated for satisfying the requirements for large-scale applications. Only a few coolers with poor IR-selectivity have realized large-scale fabrication so far.

Besides, radiative cooler, functioning outdoor and exposing to sunlight for long time, also requires excellent UV resistance. Those existing scalable structures often contain polymer in the cooling layer to achieve high IR emissivity and solar transmittance simultaneously. However, UV degradation is inevitable for polymer materials.

Two US patent applications, US20170350121A1 and US20190086164A1, purposed scalable radiative cooler structures for radiative cooling. However, their design focuses are not to improve IR selectivity, and polymers are also adopted in their designs.

A need therefore exists for an improved radiative cooling structure that eliminates or at least diminishes the disadvantages and problems described above.

SUMMARY

Provided herein is a radiative cooling structure comprising: a reflective layer; a ceramic infrared (IR)-selectively emissive layer having an average emissivity within a wavelength region of 8 μm to 13 μm; and a ceramic emission boosting layer comprising a monolayer of ceramic particles for boosting an overall emissivity of the radiative cooling structure within the wavelength region thereby improving a cooling power of the radiative cooling structure; wherein the ceramic IR-selectively emissive layer is disposed between the reflective layer and the ceramic emission boosting layer.

In certain embodiments, the ceramic IR-selectively emissive layer comprises a first silicon-based ceramic material; and each ceramic particle comprises a second silicon-based ceramic material.

In certain embodiments, the first silicon-based ceramic material is silica ($SiO_2$), silicon nitride ($Si_3N_4$) or silicon oxynitride $SiO_xN_y$; and the second silicon-based ceramic material is $SiO_2$, $Si_3N_4$ or $SiO_xN_y$.

In certain embodiments, the x in $SiO_xN_y$ is between 0.1 and 2; and the y in $SiO_xN_y$ is between 0.1 and 2.

In certain embodiments, the ceramic particles are bonded to the ceramic IR-selective emissive layer via chemical bonding, physical bonding or a combination of the chemical bonding and the physical bonding.

In certain embodiments, the monolayer has a closely packed structure, in which the ceramic particles are closely packed.

In certain embodiments, the monolayer has a non-closely packed structure, in which the ceramic particles are packed with an average inter-particle spacing.

In certain embodiments, the average inter-particle spacing is from 0.5 to 1.5 times of an average particle size of the ceramic particles.

In certain embodiments, the each ceramic particle is solid or hollow.

In certain embodiments, the monolayer is formed by a Langmuir-Blodgett (LB) method or a spray coating.

In certain embodiments, the average emissivity is between 0.5 and 1.

In certain embodiments, the reflective layer has an average reflectivity of 0.95 to 1 within a solar wavelength region of 0.3 μm to 2.5 μm.

In certain embodiments, the radiative cooling structure further comprises a ceramic bonding layer disposed between the ceramic IR-selectively emissive layer and the ceramic emission boosting layer such that the ceramic particles are bonded to the ceramic bonding layer via chemical bonding, physical bonding or a combination of the chemical bonding and the physical bonding.

In certain embodiments, the ceramic bonding layer comprises a third Si-based material and has a thickness of 0.1 μm to 2 μm.

In certain embodiments, the radiative cooling structure further comprises a ceramic protective layer disposed between the ceramic bonding layer and the ceramic IR-selective emissive layer for protecting the ceramic IR-selective emissive layer.

In certain embodiments, the ceramic IR-selectively emissive layer is a silicon oxynitride ($SiO_xN_y$) layer having a thickness of 1 μm to 5 μm for avoiding infrared emission outside the wavelength region; and each ceramic particle is a Si-based particles and has a particle size of 1 μm to 3 μm such that the monolayer enables to avoid infrared emission outside the wavelength region thereby improving the cooling power of the radiative cooling structure.

In certain embodiments, the ceramic IR-selectively emissive layer is a $SiO_xN_y$ layer having a thickness of 1 μm to 5 μm for avoiding infrared emission outside the wavelength region; the monolayer has a closely packed structure, in which the ceramic particles are closely packed, each ceramic particle being a $SiO_2$ particle and having a particle size of 1 μm to 3 μm such that the monolayer enables avoid infrared emission outside the wavelength region thereby improving the cooling power of the radiative cooling structure; and the ceramic bonding layer is $SiO_2$ layer having a thickness of 0.1 μm to 2 μm.

Provided herein is a method for removing heat from a body comprising: locating the radiative cooling structure described above in thermal communication with a surface of the body; transferring the heat from the body to the radiative cooling structure; and radiating the heat from the ceramic IR-selectively emissive layer and the ceramic emission boosting layer thereby removing the heat from the body.

Provided herein is a method for fabricating the radiative cooling structure described above comprising: providing the reflective layer; forming the ceramic IR-selectively emissive layer on the reflective layer; and forming the ceramic emission boosting layer on the ceramic IR-selective emissive layer by a Langmuir-Blodgett (LB) method or a spray coating.

Provided herein is a method for fabricating the radiative cooling structure described above comprising: providing the reflective layer; forming the ceramic IR-selectively emissive layer on the reflective layer; forming the ceramic bonding layer on the ceramic IR-selectively emissive layer; and forming the ceramic emission boosting layer on the ceramic bonding layer by a LB method or a spray coating.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects of the present invention are disclosed as illustrated by the embodiments hereinafter.

BRIEF DESCRIPTION OF DRAWINGS

The patent or application file contains at least one drawing executed in color. Copies of this patent or patent application publication with color drawing(s) will be provided by the Office upon request and payment of the necessary fee.

The appended drawings, where like reference numerals refer to identical or functionally similar elements, contain figures of certain embodiments to further illustrate and clarify the above and other aspects, advantages and features of the present invention. It will be appreciated that these drawings depict embodiments of the invention and are not intended to limit its scope. The invention will be described and explained with additional specificity and detail through the use of the accompanying drawings in which.

Figure 1:
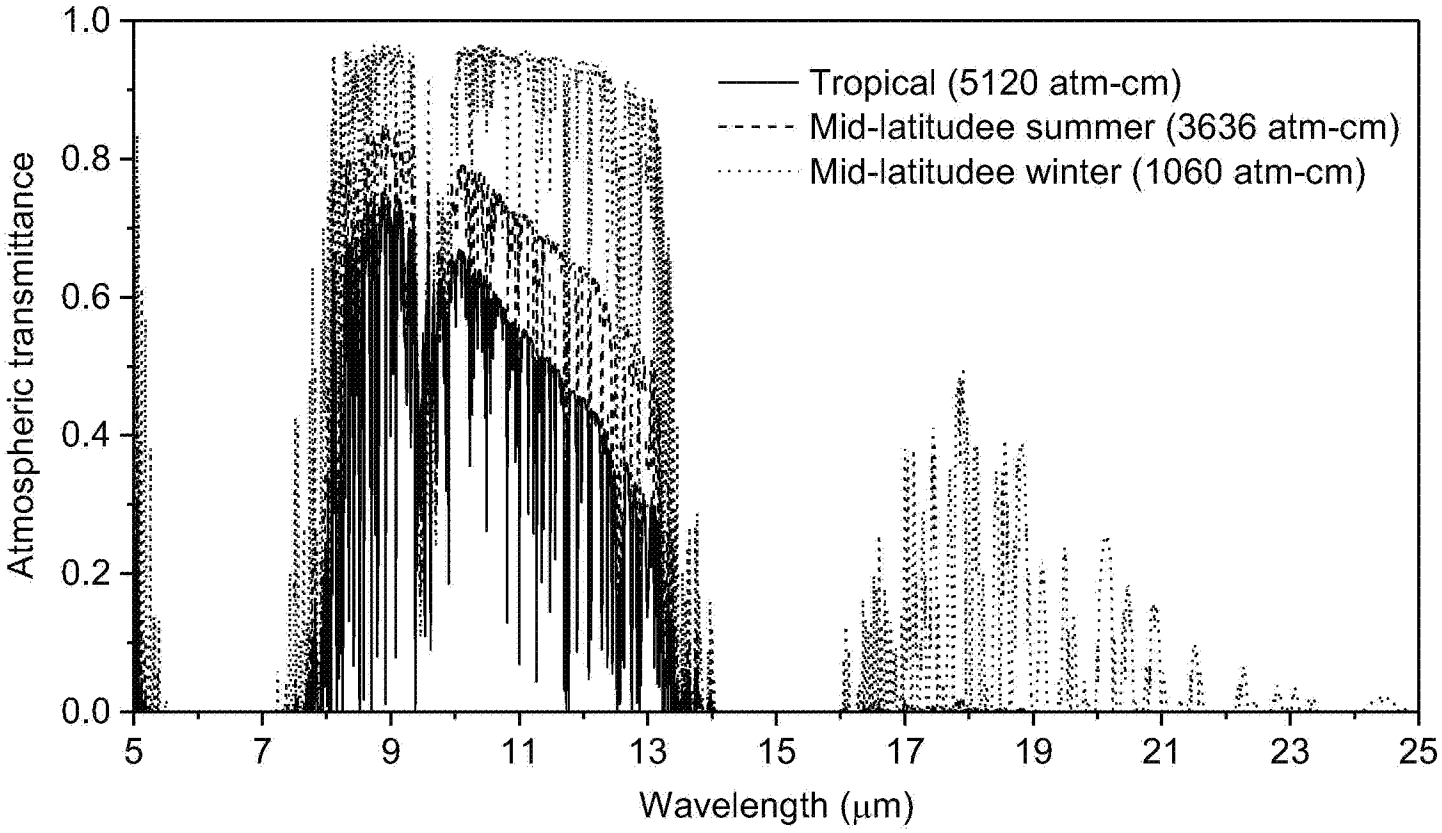
FIG. 1 shows transmittance spectra of atmosphere in different areas.

Skilled artisans will appreciate that elements in the figures are illustrated for simplicity and clarity and have not necessarily been depicted to scale.

DETAILED DESCRIPTION OF THE INVENTION

As used herein in the specification and appended claims, the term "avoid" or "avoiding" refers to any method to partially or completely preclude, avert, obviate, forestall, stop, hinder or delay the consequence or phenomenon following the term "avoid" or "avoiding" from happening. The term "avoid" or "avoiding" does not mean that it is necessarily absolute, but rather effective for providing some degree of avoidance or prevention or amelioration of consequence or phenomenon following the term "avoid" or "avoiding".

It will be apparent to those skilled in the art that modifications, including additions and/or substitutions, may be made without departing from the scope and spirit of the invention. Specific details may be omitted so as not to obscure the invention; however, the disclosure is written to enable one skilled in the art to practice the teachings herein without undue experimentation.

The present disclosure provides a radiative cooling structure providing IR selectivity and realized by an all-inorganic structure and scalable solution-based fabrication process. It is therefore promising to address the issues mentioned above for real applications.

The present radiative cooling structure is to address the issues with conventional daytime radiative coolers, e.g., poor scalability, high cost, short lifespan, poor cooling performance under high humidity. Accordingly, the present disclosure provides a solution-processed radiative cooler with great IR selectivity and excellent long-term UV resistant due to its all-inorganic components, and great potential for scalable manufacture.

Certain embodiments of the present disclosure provide a radiative cooler including an inorganic solar reflective layer, a ceramic IR-selectively emissive layer and a ceramic emission boosting layer. A protective layer and a bonding layer can also be provided between ceramic IR-selectively emissive layer and ceramic emission boosting layer.

Certain embodiments of the present disclosure provide an IR-selectively radiative cooler with high emissivity mainly within atmospheric window (between 8 to 13 microns) while high reflectivity in other wavelength regions, which is critical to achieve excellent cooling performance, especially in high humidity areas. This cooler includes one ceramic layer with relatively large extinction coefficient between 8 and 13 microns compared to other wavelength regions. The ceramic IR-selectively emissive layer can be a $SiO_2$ layer, a SiN layer or a composite ceramic $SiO_xN_y$ layer. Accurate control of thickness is important to attain great IR-selectivity. The thickness of the ceramic layer is preferably below 10 microns and depends on the compositions of the ceramic material used. This cooler can be made through solution process like spin coating, spray coating and paint coating, etc.

Certain embodiments of the present disclosure provide a particles-based emission boosting layer deposited on top of IR-selective cooler. One ceramic layer functioning as IR-selective cooler can provide emissivity in sky window up to around 80%, but this value is difficult to be further improved since its thickness should be controlled for maintaining IR-selectivity and some surface reflection exists caused by large extinction coefficient. Thus, this emission boosting layer, containing only a monolayer of ceramic particles, is presented to suppress the surface reflection by forming a gradient-index subwavelength structure and then further increase emissivity within 8-13 μm, while maintain high reflectivity out of this region at the same time. Phonon resonance caused by proper size of proper materials can also transfer reflection within 8-13 μm of IR-selective emissive layer to emission of the structure. Besides, closely packed ceramic particles can largely increase the surface area and further improve emissive power of the cooler. Scattering of visible light by those particles can turn the mirror appearance to white color and then avoid light pollution in real application.

In certain embodiments, all the layers of the radiative cooling structures are inorganic, which can extend the lifespan of radiative cooler. All these layers can be deposited on rigid substrate or flexible substrate and the IR-selectively emissive layer as well as the emission boosting layer can be deposited through solution-based processes. This makes this cooler promising for low-cost and large-scale fabrication.

Three typical transmittance spectra of atmosphere in different areas, including tropical area with high humidity (e.g., water column=5120 atm-cm), mid-altitude summer with medium humidity (e.g., water column=3636 atm-cm) and mid-altitude winter with low humidity (e.g., water column=1060 atm-cm), are shown in FIG. 1, all of which show high transmittance between 8 and 13 microns. There are also some small transmission windows beyond this region for mid-altitude area, especially the one in mid-altitude winter. However, for tropical area, transmittance mainly exists within 8-13 microns. That means that only those emissions within 8 to 13 microns contribute to cooling power for a radiative cooler in a tropical area. For mid-altitude areas with some secondary sky windows, infrared emissions beyond 8-13 μm are helpful for improving initial cooling power, but they still block the temperature reduction since the transmission in those secondary windows is not high. Thus, an ideal radiative cooler should have high emissivity only within 8-13 μm and maintain perfect reflectivity in other wavelength regimes. However, all reported scalable radiative coolers, so far, have high emissivity across the whole IR spectrum showed in FIG. 1. This problem is solved by the cooling structure of the present disclosure with great IR-selectivity offered by both of the ceramic IR selectively emissive layer and emission boosting layer, which can be fabricated with solution processes.

Figure 2:
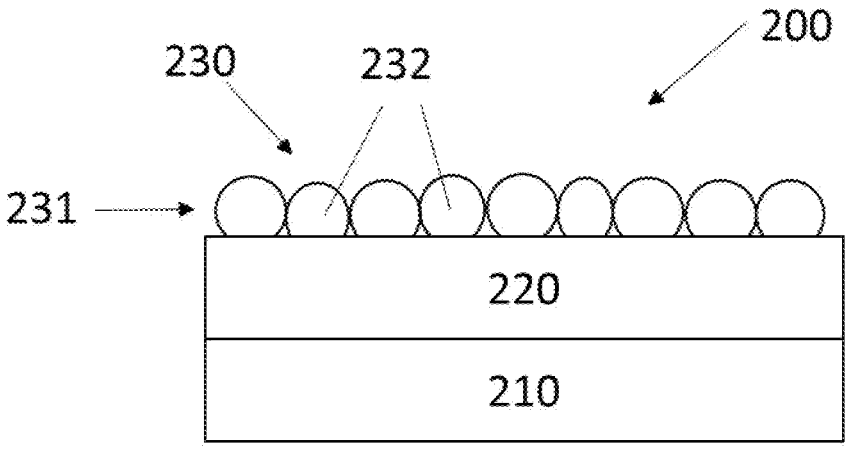
FIG. 2 shows a schematic diagram depicting a radiative cooling structure according to certain embodiments of the present disclosure.

FIG. 2 provides a radiative cooling structure according to certain embodiment of the present disclosure. The radiative cooling structure 200 comprises a reflective layer 210, a ceramic IR-selectively emissive layer 220 and a ceramic emission boosting layer 230. The ceramic IR-selectively emissive layer 220 is sandwiched between the reflective layer 210 and the ceramic emission boosting layer 230. The ceramic IR-selectively emissive layer has a high emissivity (e.g., an average emissivity above 0.5 or between 0.5 and 1) within a wavelength region of 8 μm to 13 μm while low emissivity (e.g., between 0 and 0.5, between 0 and 0.3, or between 0 and 0.1) outside the wavelength region. The ceramic emission boosting layer 230 consists of a monolayer 231 (with one-particle thickness) of ceramic particles 232, and the ceramic particles 232 are chemically and/or physically bonded to the ceramic IR-selective emissive layer 220. The ceramic particle 232 can be spherical or in any other shapes.

In certain embodiments, the ceramic IR-selectively emissive layer comprises a silicon-based ceramic material.

In certain embodiments, the ceramic IR-selectively emissive layer is a silicon oxynitride ($SiO_xN_y$) layer having a thickness of 1 μm to 5 μm such that the ceramic IR-selectively emissive layer enables to emit infrared radiation within the wavelength region of 8-13 μm and avoid infrared emission outside the wavelength region. The x in $SiO_xN_y$ can be between 0.1 and 2, and the y in $SiO_xN_y$ can be between 0.1 and 2. The average emissivity of ceramic IR-selectively emissive layer can be between 0.75 and 0.85 within the wavelength region of 8 μm to 13 μm. The ceramic IR-selectively emissive layer can have a thickness of 2 μm to 5 μm for improving the selective IR emission.

In certain embodiments, each ceramic particle comprises a silicon-based ceramic material and has a particle size of 1

μm to 3 μm such that the monolayer enables to boost an overall emissivity (e.g., up to a range between 0.9 and 0.95) of the radiative cooling structure within the wavelength region of 8-13 μm and avoid infrared emission outside the wavelength region thereby improving a cooling power of the radiative cooling structure. The silicon-based ceramic material is $SiO_2$, $Si_3N_4$ or $SiO_xN_y$. The ceramic particles are chemically bonded and/or physically bonded (e.g., by Van der Waals forces) to the ceramic IR-selective emissive layer. The ceramic particles are closely packed within the monolayer.

In certain embodiments, the reflective layer has an average reflectivity of 0.95 to 1 within a solar wavelength region of 0.3 μm to 2.5 μm. The reflective layer can be a silver layer, an aluminum layer or a silver-coated aluminum layer. The reflective layer can have a thickness of 0.1 μm to 2 μm.

Figure 3:
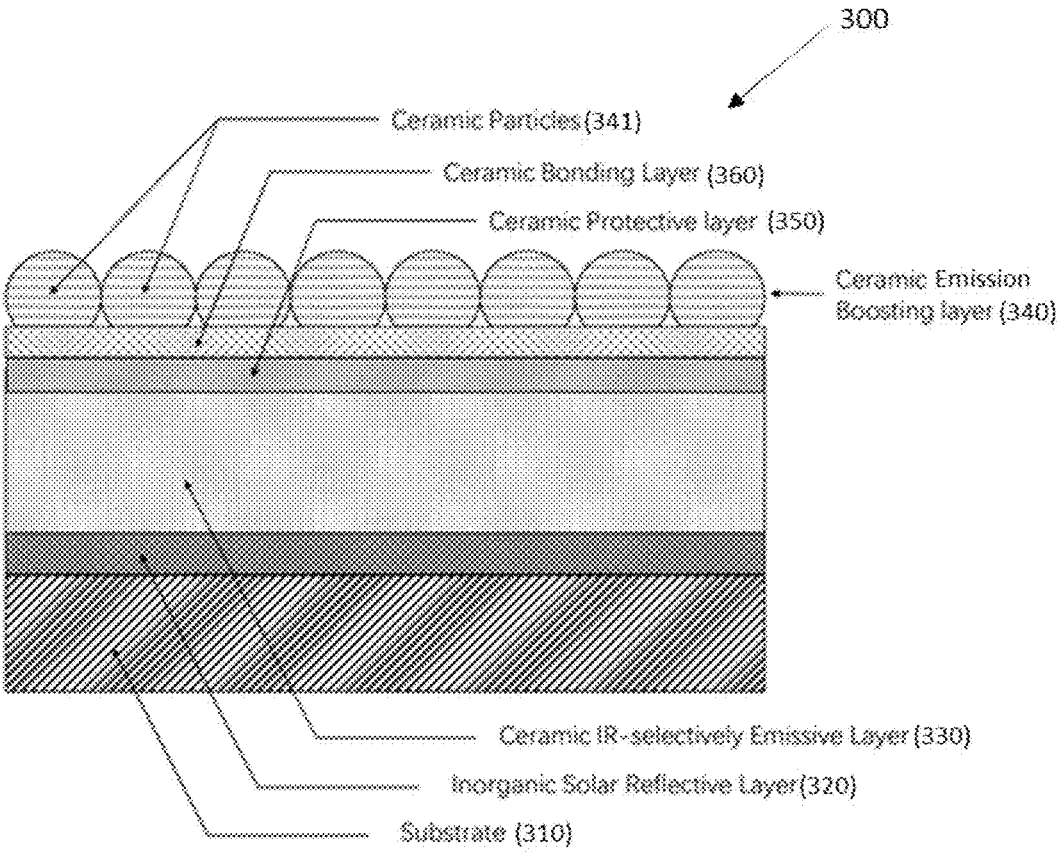
FIG. 3 shows a schematic diagram depicting an inorganic IR-selectively radiative cooler according to certain embodiments of the present disclosure.

FIG. 3 depicts an inorganic IR-selective daytime radiative cooler 300 having the radiative cooling structure of the present disclosure. A substrate 310 is located on the bottom for supporting the radiative cooling structure. An inorganic solar reflective layer 320 is deposited on the substrate 310 to reflect solar energy for avoiding heat absorption from sun light. A ceramic IR-selectively emissive layer 330 is coated on the reflective layer 320, and mainly contains a composite of silicon, nitrogen and oxygen and has a chemical formula of $SiO_xN_y$. The thickness of the ceramic IR-selectively emissive layer 330 should be controlled to guarantee good IR selectivity. In order to further improve emissivity within the atmospheric transmission window (8-13 μm), a ceramic emission boosting layer 340 is provided on the top of the ceramic IR-selectively emissive layer 330. This ceramic emission boosting layer 340 contains a monolayer of ceramic particles 341, and mainly boosts emissivity over the wavelength range from 8 to 13 microns, while maintaining low emissivity out of this wavelength range. Meanwhile, this ceramic emission boosting layer 340 can cause diffusive solar reflection to avoid light pollution. Between the ceramic IR-selectively emissive layer 330 and ceramic emission boosting layer 340, in this embodiment, a ceramic protective layer 350 and a ceramic bonding layer 360 are added to improve the durability of this radiative cooler.

The substrate 310 is used to support the radiative cooler 300. This substrate can be any solid materials with relevantly smooth surface, including a hard plate (e.g., a metal, glass or wood plate), or a flexible thin film (e.g., a copper film or PET film). Organic materials can also be used as substrate, because the ultraviolet is blocked by the upper reflective layer 320 and it would not damage the durability of the radiative cooler 300. The shape of substrate is not limited.

The inorganic solar reflective layer 320 is deposited on the substrate 310. For daytime application, sun light is the main heat source and absorption of solar energy will increase the temperature of a surface or subject immediately. Thus, high reflectivity with solar spectrum, mainly between 0.3 and 2.5 μm on earth surface, is necessary. The reflective layer is inorganic in this embodiment to achieve a long lifespan. The inorganic solar reflective layer 320 can be a layer of metal, a layer of ceramic particles with high refractive index or even a multilayer structure with reflection enhancement design.

On the top of the inorganic solar reflective layer 320, the ceramic IR-selectively emissive layer 330 is coated to provide improvement of emissivity mainly within 8-13 microns. The material of this layer should have strong extinction coefficient in 8-13 μm, but weak or zero extinction coefficient in other infrared wavelength. The thickness of this ceramic IR-selectively emissive layer 330 should be precisely controlled to provide high emissivity only within the atmospheric transmission window.

Once there are extinction peaks existing from 8 to 13 microns, materials will also show relevantly high reflectivity on the surface corresponding to the peaks. This phenomenon limits the maximization of emissivity. Thus, a monolayer of ceramic particles 341, being the emission boosting layer 340, is disposed on the ceramic IR-selectively emissive layer 330 to further improve the emissivity of radiative cooler 300.

There are at least four functions of this ceramic emission boosting layer 340. Firstly, shaping the surface of IR-selective cooling layer to change its effective refractive index and then reduce the surface reflection. Secondly, using proper material and particle size can make this emission boosting layer perform photon resonance within 8-13 μm so that to improve the overall (resultant) emissivity (e.g., up to a range between 0.9 and 0.95) of the whole structure within the transmission window (based on the contribution at least from both of the ceramic IR-selectively emissive layer and ceramic emission boosting layer). Thirdly, the emissive area of radiative cooler can be increased by introducing closely packed monolayer of particles on the surface, leading to improved emission power. Fourthly, scattering visible light to cause diffusive reflection of sun light instead of specular reflection, which avoids light pollution in real application.

In this embodiments, on top of the ceramic IR-selectively emissive layer 330, the ceramic protective layer 350 is coated to protect the IR-selectively emissive layer 330 from the attack from ambient such as reactions with air, which will lead to the change of optical properties of the IR-selective cooling layer 330. For some precursors of the ceramic IR-selectively emissive layer 340, this protective layer 350 can be formed automatically after the natural process of solidification. In that case, the process of additional protective layer 350 can be exempted.

In this embodiment, the ceramic bonding layer 360 is added between the ceramic protective layer 350 and the ceramic emission boosting layer 360, which can firmly bond the monolayer of the ceramic particles 341 on the surface, avoiding detachment or damage of emission boosting layer 360 in usage. This ceramic bonding layer 360 can be formed with the same material of the ceramic protective layer 350, such that those two layers can be combined as one to simplify both of the structure and the fabrication process.

A computer simulation for simulating infrared emissive spectra of a monolayer of silica spheres with different diameters under a closely packed structure and non-closely packed structures was conducted and the corresponding simulation results are shown in FIGS. 4A-4D.

Figure 4A:
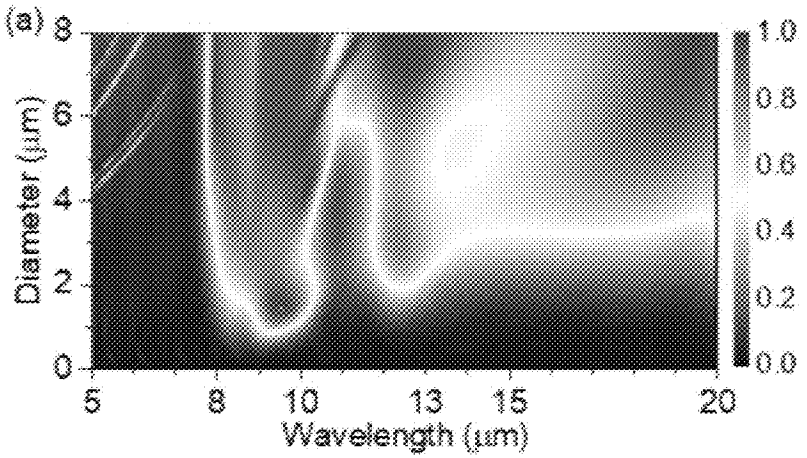
FIG. 4A shows infrared emissive spectra of a monolayer of silica spheres with different diameters under a closely packed structure.

Referring to FIG. 4A, in the case that the silica spheres are closely packed (it means that there is no spacing between two silica spheres), when the diameter of the silica spheres increases, the emissivity of the monolayer will increase outside the atmospheric transmission window. In contrast, when the diameter is within 1-3 μm, the monolayer exhibits good selective IR emission within the wavelength region of 8 to 13 μm. Thus, it is not favorable for selective IR emission when using the silica sphere having large diameter.

Figure 4B:
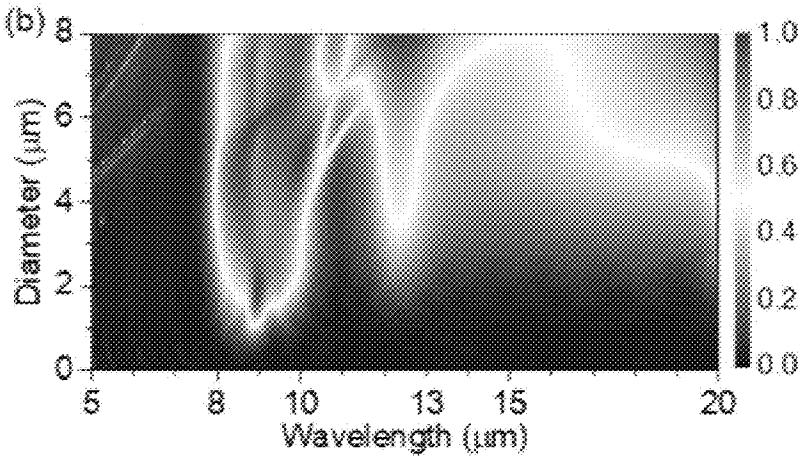
FIG. 4B shows infrared emissive spectra of a monolayer of silica spheres with different diameters under a non-closely packed structure having an inter-particle spacing (i.e., a distance from the surface of one particle to that of another) being 0.5 times of the diameter.
Figure 4C:
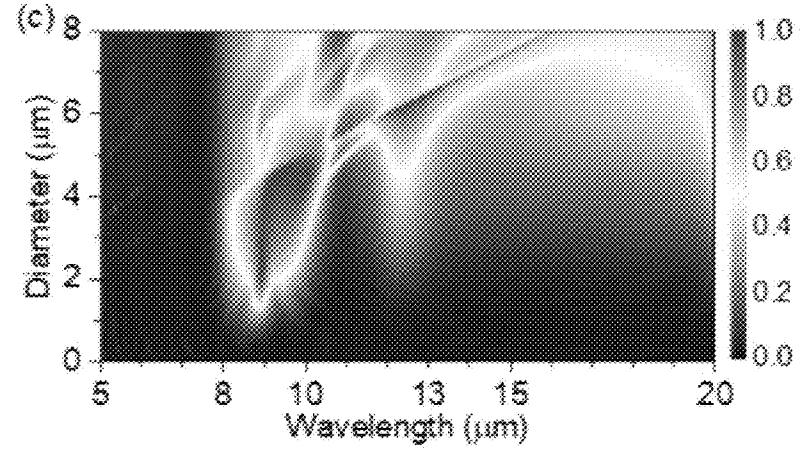
FIG. 4C shows infrared emissive spectra of a monolayer of silica spheres with different diameters under a non-closely packed structure having an inter-particle spacing being 1 times of the diameter.
Figure 4D:
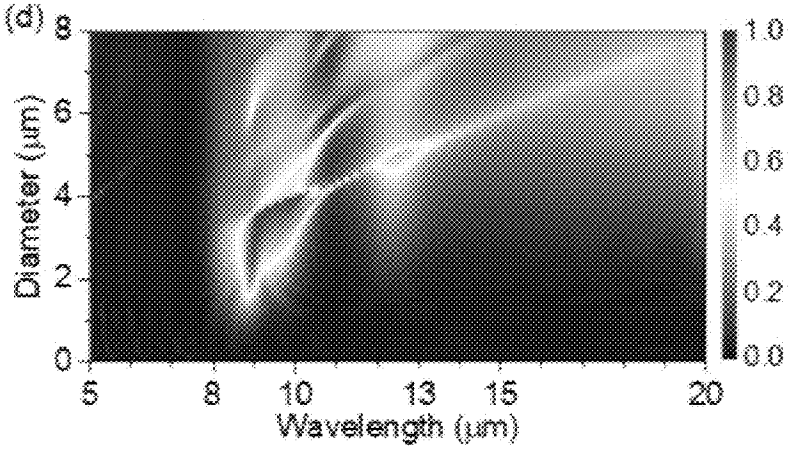
FIG. 4D shows infrared emissive spectra of a monolayer of silica spheres with different diameters under a non-closely packed structure having an inter-particle spacing being 1.5 times of the diameter.

Referring to FIG. 4B, in the case that the silica spheres are non-closely packed and have an average inter-particle spacing being 0.5 times of the diameter, when the diameter of the silica spheres increases, the emissivity of the monolayer will sharply increase outside the atmospheric transmission window. It is similar to the result of FIG. 4A Referring to FIGS. 4B-4C, when the average inter-particle spacing increases from 0.5 times to 1.5 times of the diameter, the emissivity of the monolayer decreases. Thus, it is preferred to have smaller diameter in the closely packed structure but larger diameter in the non-closely packed structure.

Figure 5A:
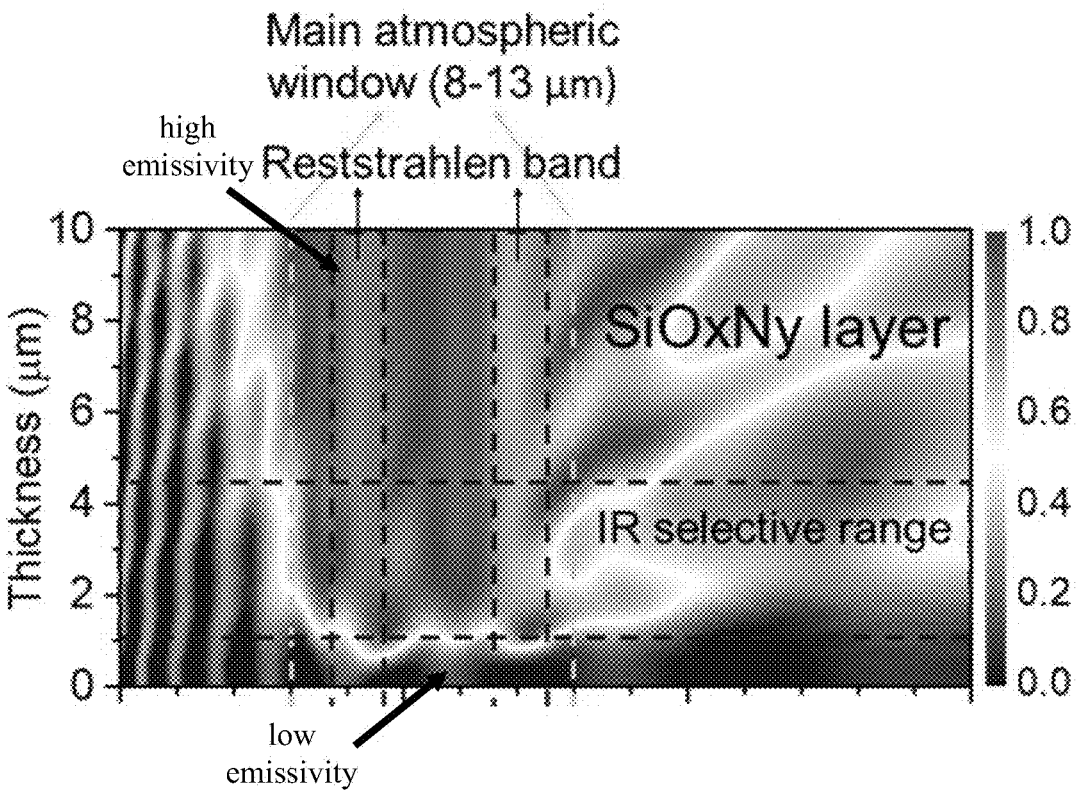
FIG. 5A shows infrared emissive spectra of a $SiO_xN_y$ layer with different thickness.
Figure 5B:
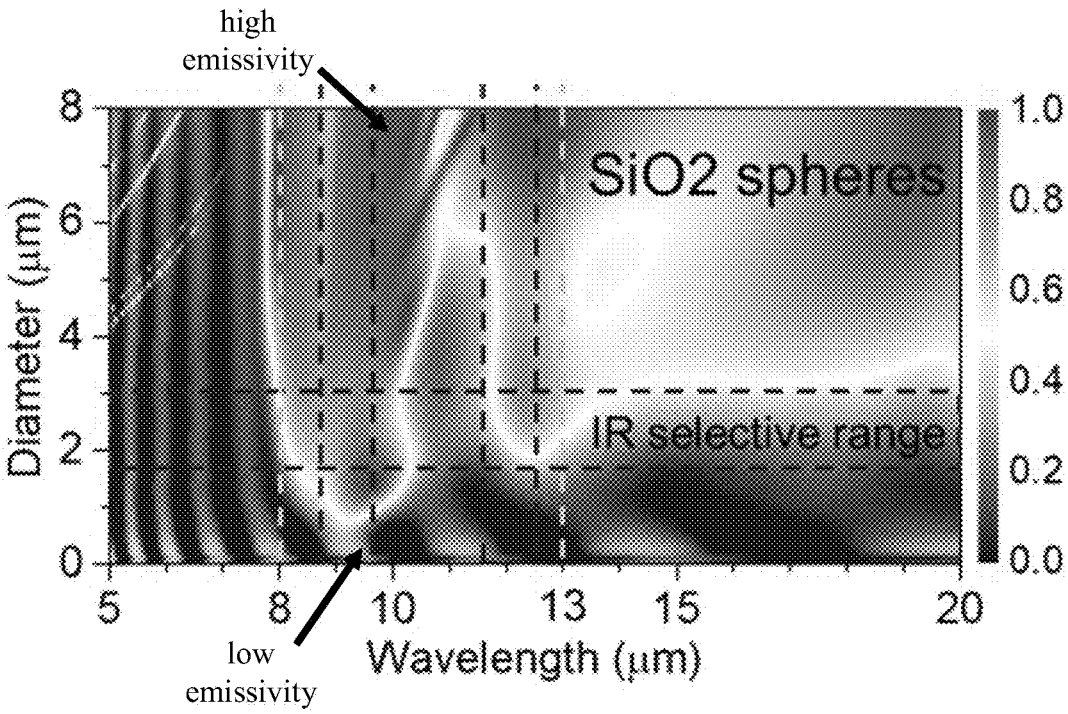
FIG. 5B shows infrared emissive spectra of a monolayer of silica spheres with different diameters under a closely packed structure.

A computer simulation for simulating infrared emissive spectra of a $SiO_{1.25}N_{0.25}$ layer and a monolayer of silica spheres with different diameters under a closely packed structure was conducted and the corresponding simulation results are shown in FIGS. 5A and 5B. The thickness effect of the IR-selectively emissive layer and the diameter effect of the emission boosting layer are shown in this simulation. The thickness effect is substantially based on the intrinsic absorption and reflection of the $SiO_xN_y$ layer. The diameter effect is substantially based on the surface phonon-polariton (SPhP) resonance of the silica spheres.

Referring to FIG. 5A, when the thickness of the silicon oxynitride layer increases, the emissivity of the monolayer will sharply increase outside the atmospheric transmission window. In contrast, when the thickness is within 1-5 μm, the monolayer exhibits good selective IR emission within the wavelength region of 8 to 13 μm, and the corresponding Reststrahlen band lies substantially within the main atmospheric window. Thus, it is not favorable to have a thickness beyond 5 μm for selective IR emission.

Referring to FIG. 5B, when the diameter is within 1-3 μm, the monolayer exhibits good selective IR emission within the wavelength region of 8 to 13 μm, and the corresponding Reststrahlen band lies substantially within the main atmospheric window. In combination of the two simulation results, it is preferred to have a silicon oxynitride layer with a thickness between 1 and 5 μm and a monolayer with silica particles having a diameter between 1 and 3 μm in order to provide good selective IR emission. In view thereof, proper thickness of the silicon oxynitride layer and proper diameter of silica sphere enable to provide focusing emission in the main atmospheric window (8-13 um) in order to achieve great IR selectivity.

Figure 6:
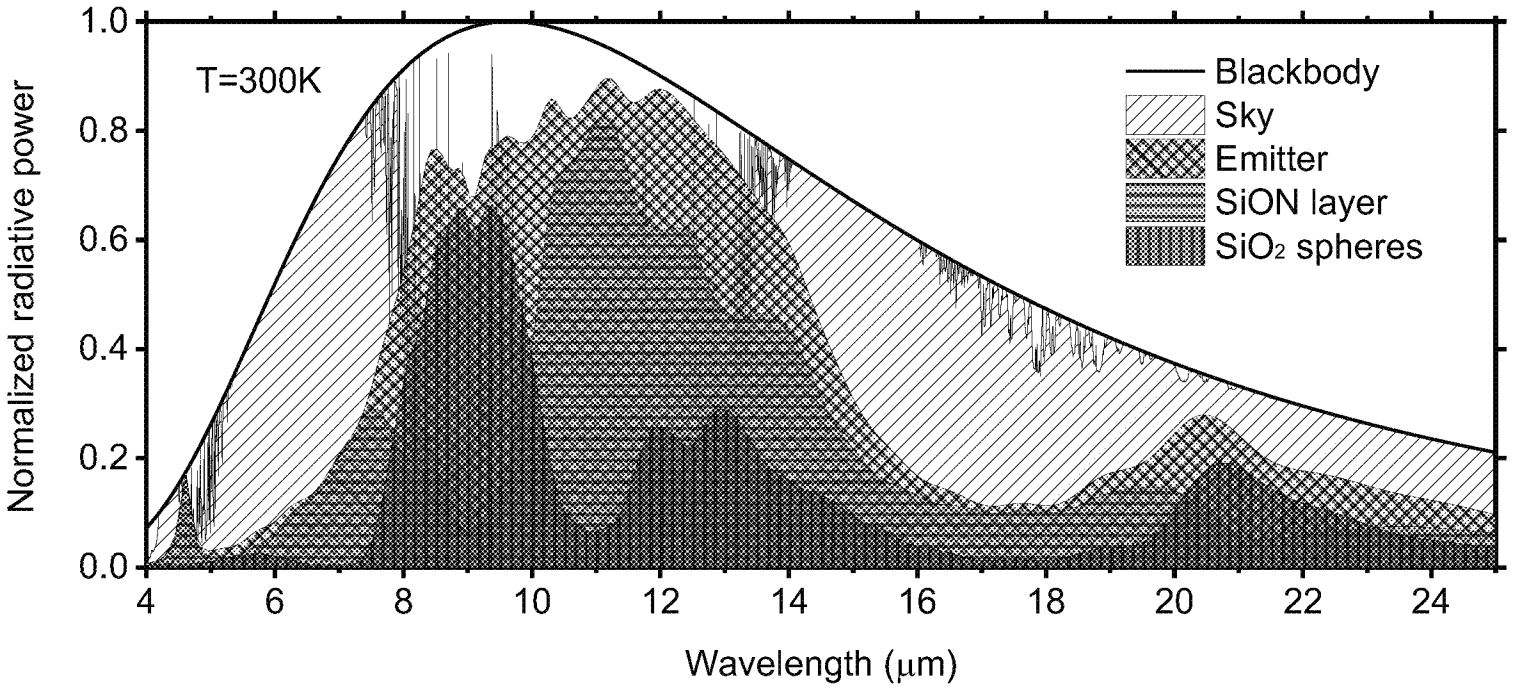
FIG. 6 shows normalized radiative power versus wavelengths for an inorganic IR-selectively radiative cooler according to certain embodiments of the present disclosure.

FIG. 6 shows normalized radiative power versus wavelengths for an inorganic IR-selectively radiative cooler according to certain embodiments of the present disclosure. Silica particles with a particle size of about 2 μm are used for the emission boosting layer. The emission contribution by the boosting layer is analyzed as below. The emission boosting layer mainly boosts the emission at the wavelength range of 8-9 μm and around 12 μm. Correspondingly, the $SiO_{1.25}N_{0.25}$ layer with a thickness of about 4 μm exhibits relatively low emission at wavelength range of 8-9 μm and around 12 μm. Accordingly, the emission boosting layer is able to compensate the weak emission of silicon oxynitride layer at the wavelength range of 8-9 μm and around 12 μm such that overall IR emission within the atmospheric window is enhanced.

Example 1

Figure 7A:
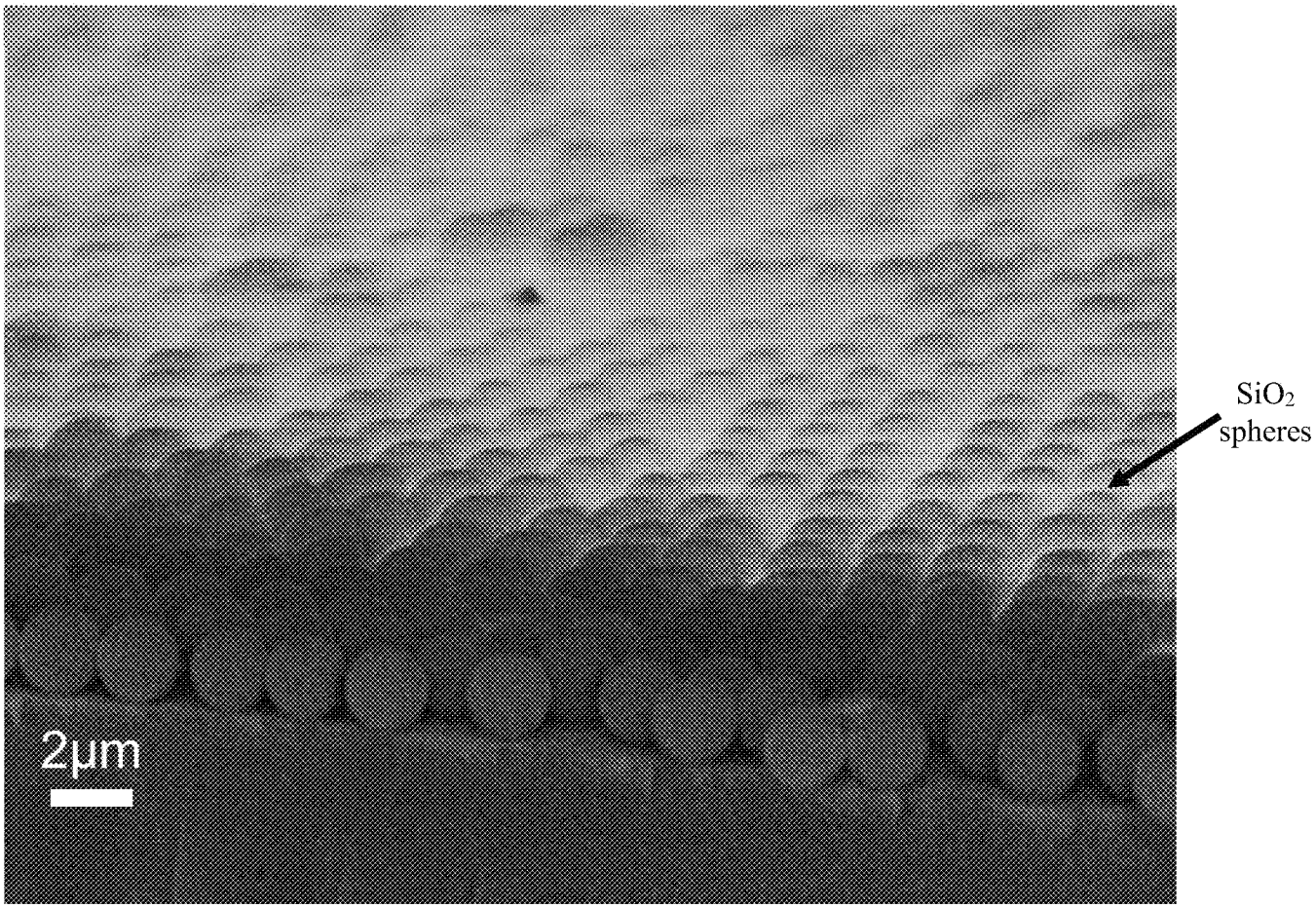
FIG. 7A shows a scanning electron microscope (SEM) image of a monolayer of $SiO_2$ spheres on an IR-selectively emissive layer according to Example 1.

In this example, an inorganic solution-processed IR-selective radiative cooler is prepared following the purposed structure and fabrication process. This cooler for passive cooling consists of a silicon wafer substrate, a silver layer with a thickness of 120 nm working as solar reflective layer, a $SiO_{1.25}N_{0.25}$ IR-selective emissive layer with a thickness of 4μm and an average emissivity of 0.8 to 0.85 within a wavelength region of 8 μm to 13 μm, an emission boosting layer with a monolayer (with one-$SiO_2$ sphere thickness) of $SiO_2$ spheres with a particle size of about 2 μm, all $SiO_2$ spheres in the monolayer are arranged in two-dimensional array and deposited on the emissive layer respectively as shown in FIG. 7A. The protective layer, a thin $SiO_2$ layer, is formed automatically on the surface of IR-selective cooling layer after the fully solidification of IR-selective cooling layer coated by PHPS. Same precursor, PHPS solution, is also used to coat a bonding layer between protective layer and emission boosting layer. Thus, in this example, a $SiO_2$ layer is form between IR-selective layer and emission boosting layer to function as both protective layer and bonding layer.

Figure 7B:
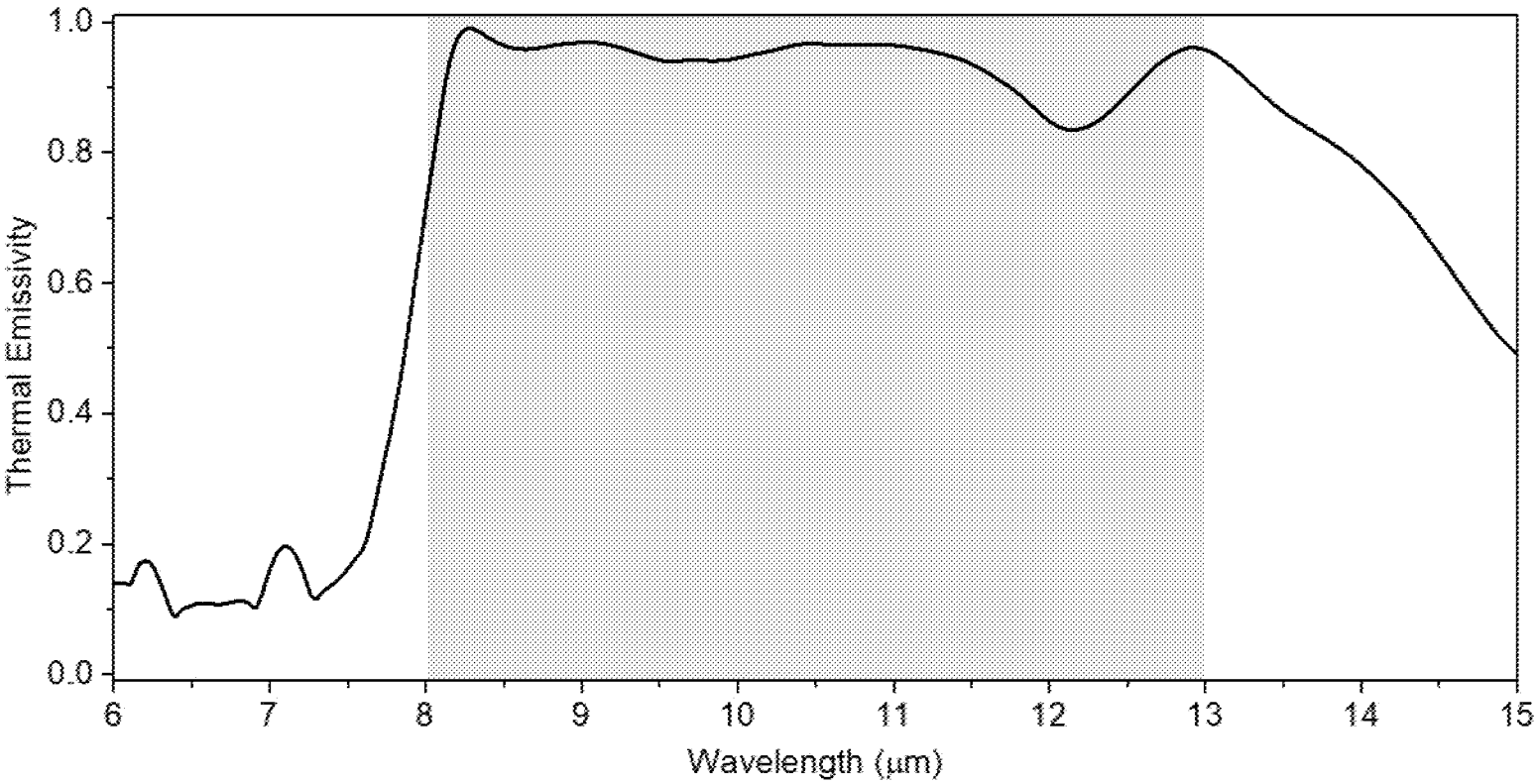
FIG. 7B shows thermal emissivity versus wavelengths for the inorganic IR-selectively radiative cooler of Example 1.

The IR spectrum of this example is shown in FIG. 7B. The average emissivity within 8-13 μm is larger than 0.9, while it drops down immediately out of this region. It shows great IR-selectivity and totally fits to the atmospheric window. The absorption of solar energy of the present design can be controlled below 4%.

Figure 8:
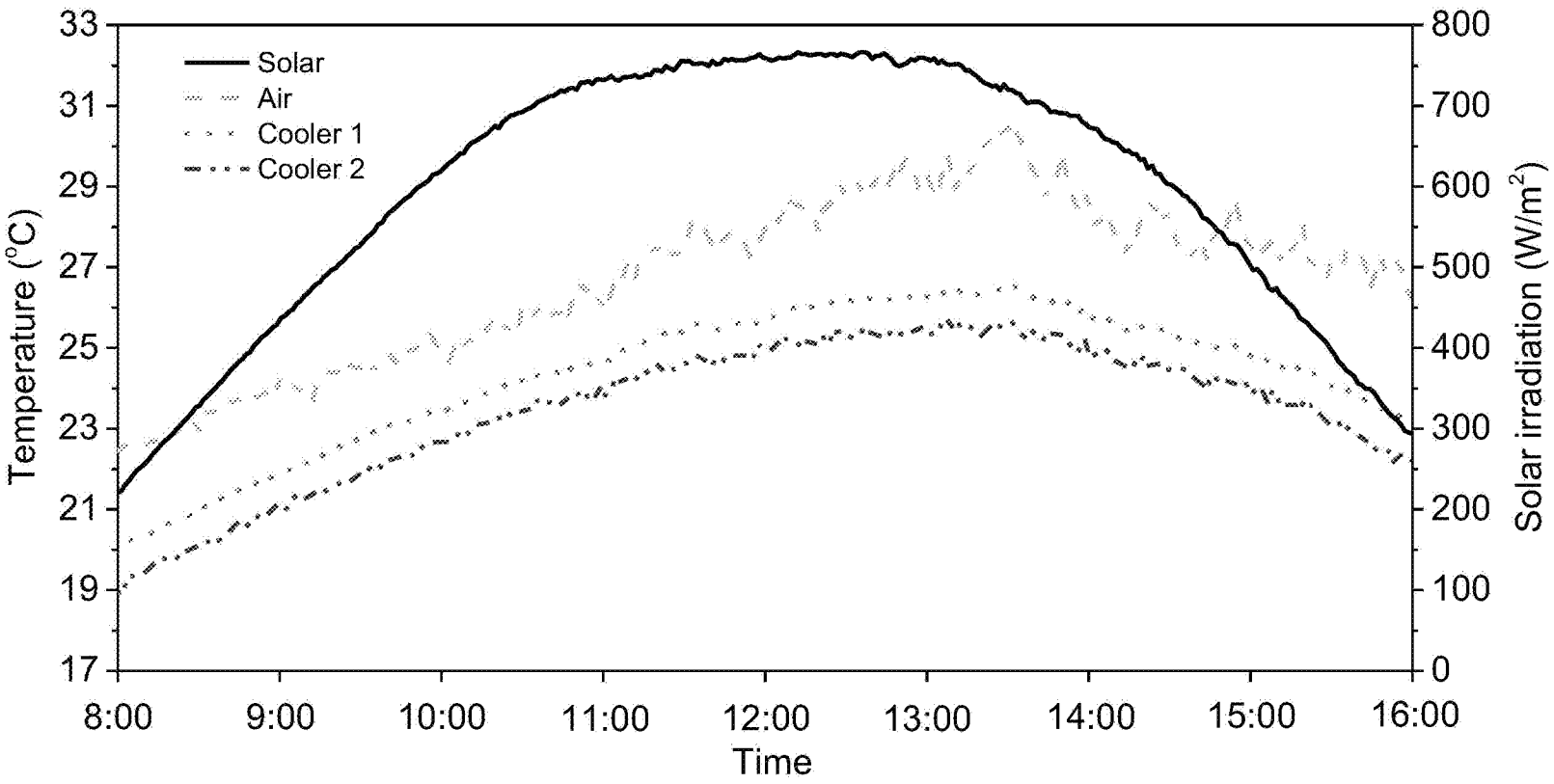
FIG. 8 shows temperature of two inorganic IR-selective radiative coolers without the ceramic emission boosting layer (control sample) and with the ceramic emission boosting layer (Example 1) in a high humidity area in Hong Kong.

FIG. 8 shows a radiative cooling test result with the radiative cooler of Example 1. The cooler 1 (control sample) does not have the ceramic emission boosting layer, while the cooler 2 (Example 1) has the ceramic emission boosting layer. The cooler 1 and cooler 2 were put on the rooftop at daytime, exposing to the sunlight directly. Temperature of the ambient air, and those two coolers were recorded. Also the solar irradiation power was recorded. 2-4° C. cooling can be observed for the cooler 1, while around 1° C. more cooling was recorded for the cooler 2 that evidences the ceramic emission boosting layer able to enhance the cooling power of the radiative cooler.

The present disclosure further provides a method for removing heat from a body comprising: locating the radiative cooling structure described above in thermal communication with a surface of the body; transferring the heat from the body to the radiative cooling structure; and radiating the heat from the ceramic IR-selectively emissive layer and the ceramic emission boosting layer thereby removing the heat from the body.

The present disclosure further provides a method for fabricating the radiative cooling structure described above comprising: providing the reflective layer; forming the ceramic IR-selectively emissive layer on the reflective layer; and forming the ceramic emission boosting layer on the ceramic IR-selective emissive layer by a Langmuir-Blodgett (LB) method or a spray coating.

In certain embodiments, a method for fabricating the radiative cooling structure described above comprises: providing the reflective layer; forming the ceramic IR-selectively emissive layer on the reflective layer; forming the ceramic bonding layer on the ceramic IR-selectively emissive layer; and forming the ceramic emission boosting layer on the ceramic bonding layer by a LB method or a spray coating. Optionally, the method further comprises depositing a ceramic covering layer on the ceramic emission boosting layer for fixing ceramic emission boosting layer within the radiative cooling structure. In certain embodiments, the ceramic covering layer covers the spheres and fills the spaces among spheres such that the spheres are enclosed in the ceramic covering layer. In certain embodiments, the ceramic covering layer comprises $SiO_2$, SiN or $SiO_xN_y$.

Figure 9:
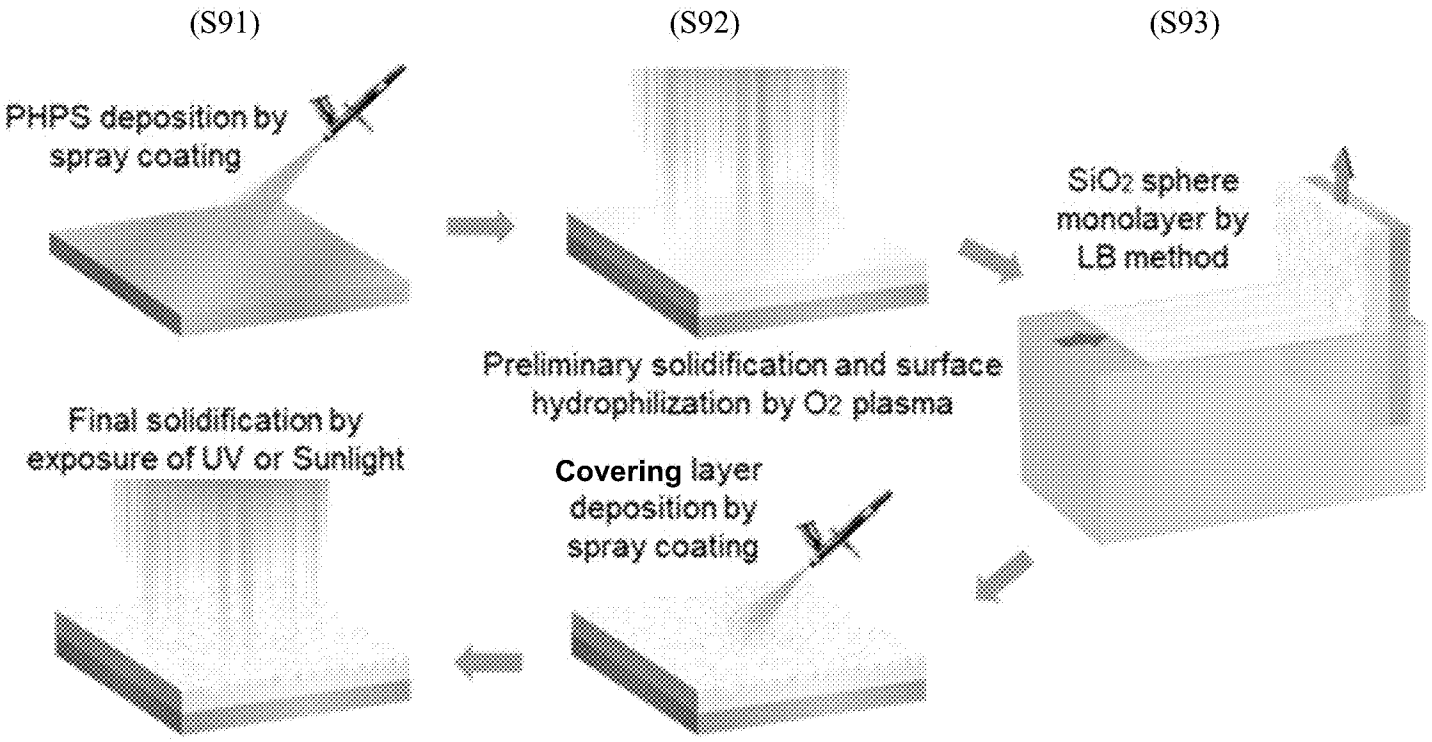
FIG. 9 is a flow chart depicting a method for fabricating a radiative cooling structure according to certain embodiments of the present disclosure.

FIG. 9 is a flow chart depicting a method for fabricating a radiative cooling structure according to certain embodiments of the present disclosure. In step S91, silazane (PHPS) is deposited on a reflective layer by spray coating. In step S92, the PHPS is solidified to form to a ceramic IR-selectively emissive layer, and the surface of the ceramic IR-selectively emissive layer is modified with surface hydrophilization by oxygen plasma to provide a hydrophilic surface for subsequent monolayer deposition. In step S93, a monolayer of silica spheres is formed on the ceramic IR-selectively emissive layer by a LB method. In step S94, a ceramic covering layer is deposited on the monolayer of silica spheres by spray coating. In step S95, the whole structure is fully solidified by exposure of ultraviolet light or sunlight for fixing the monolayer of silica spheres within the radiative cooling structure.

The present radiative cooling structure is applicable, but not limited, to construction cooling, vehicle cooling, outdoor electric box cooling, and etc.

Thus, it can be seen that an improved radiative cooling structure for passive cooling and fabrication process for radiative cooling structure have been disclosed which eliminates or at least diminishes the disadvantages and problems associated with prior art devices and processes. The present radiative cooling structure is able to provide high IR emission within the atmospheric transmission window while low IR emission outside the atmospheric transmission window, thereby providing narrowband emission and good IR selectivity to enhance the cooling power of the radiative cooling structure. In addition, unlike the conventional radiative cooler including polymer, certain embodiments of the radiative cooling structure can be completely made of inorganic materials to overcome the aging issue and provide better durability in harsh outdoor environment.

Although the invention has been described in terms of certain embodiments, other embodiments apparent to those of ordinary skill in the art are also within the scope of this invention. Accordingly, the scope of the invention is intended to be defined only by the claims which follow.

What is claimed is:

1. A radiative cooling structure comprising:

a reflective layer;

a ceramic infrared (IR)-selectively emissive layer having an average emissivity within a wavelength region of 8 μm to 13 μm; and a ceramic emission boosting layer comprising a monolayer of ceramic particles for boosting an overall emissivity of the radiative cooling structure within the wavelength region thereby improving a cooling power of the radiative cooling structure;

wherein the ceramic IR-selectively emissive layer is disposed between the reflective layer and the ceramic emission boosting layer.

2. The radiative cooling structure of claim 1, wherein the ceramic IR-selectively emissive layer comprises a first silicon-based ceramic material; and each ceramic particle comprises a second silicon-based ceramic material.

3. The radiative cooling structure of claim 2, wherein the first silicon-based ceramic material is silica ($SiO_2$), silicon nitride ($Si_3N_4$) or silicon oxynitride and the second silicon-based ceramic material is $SiO_2Si_3N_4$ or $SiO_xN_y$.

4. The radiative cooling structure of claim 3, wherein the x in $SiO_xN_y$ is between 0.1 and 2; and the y in $SiO_xN_y$ is between 0.1 and 2.

5. The radiative cooling structure of claim 1, wherein the ceramic particles are bonded to the ceramic IR-selective emissive layer via chemical bonding, physical bonding or a combination of the chemical bonding and the physical bonding.

6. The radiative cooling structure of claim 1, wherein the monolayer has a closely packed structure, in which the ceramic particles are closely packed.

7. The radiative cooling structure of claim 1, wherein the monolayer has a non-closely packed structure, in which the ceramic particles are packed with an average inter-particle spacing.

8. The radiative cooling structure of claim 7, wherein the average inter-particle spacing is from 0.5 to 1.5 times of an average particle size of the ceramic particles.

9. The radiative cooling structure of claim 1, wherein the each ceramic particle is solid or hollow.

10. The radiative cooling structure of claim 1, Wherein the monolayer is formed by a Langmuir-Blodgett (LB) method or a spray coating.

11. The radiative cooling structure of claim 1, wherein the average emissivity is between 0.5 and 1.

12. The radiative cooling structure of claim 1, wherein the reflective layer has an average reflectivity of 0.95 to 1 within a solar wavelength region of 0.3 μm to 2.5 μm.

13. The radiative cooling structure of claim 1 further comprising a ceramic bonding layer disposed between the ceramic IR-selectively emissive layer and the ceramic emission boosting layer such that the ceramic particles are bonded to the ceramic bonding layer via chemical bonding, physical bonding or a combination of the chemical bonding and the physical bonding.

14. The radiative cooling structure of claim 13, wherein the ceramic bonding layer comprises a third Si-based material and has a thickness of 0.1 μm to 2 μm.

15. The radiative cooling structure of claim 13, wherein:

the ceramic IR-selectively emissive layer is a $SiO_xN_y$ layer having a thickness of 1 μm to 5 μm for avoiding infrared emission outside the wavelength region;

the monolayer has a closely packed structure, in which the ceramic particles are closely packed, each ceramic particle being a $SiO_2$ particle and having a particle size of 1 μm to 3 μm such that the monolayer enables avoid infrared emission outside the wavelength region thereby improving the cooling power of the radiative cooling structure; and the ceramic bonding; layer is $SiO_2$ layer having a thickness of 0.1 μm to 2 μm.

16. The radiative cooling structure of claim 1 further comprising a ceramic protective layer disposed between the ceramic bonding layer and the ceramic IR-selective emissive layer for protecting the ceramic IR-selective emissive layer.

17. The radiative cooling structure of claim 1, wherein the ceramic IR-selectively emissive layer is a silicon oxynitride ($SiO_xN_y$) layer having a thickness of 1 μm to 5 μm for avoiding infrared emission outside the wavelength region; and each ceramic particle is a Si-based particles and has a particle size of 1 μm to 3 μm such that the monolayer enables to avoid infrared emission outside the wavelength region thereby improving the cooling power of the radiative cooling structure.

18. A method for removing heat from a body comprising:

locating the radiative cooling structure of claim 1 in thermal communication with a surface of the body;

transferring the beat from the body to the radiative cooling structure; and radiating the heat from the ceramic ER-selectively emissive layer and the ceramic emission boosting layer thereby removing the heat from the body.

19. A method for fabricating the radiative cooling structure of claim 1 comprising:

providing the reflective layer;

forming the ceramic IR-selectively emissive layer on the reflective layer; and forming the ceramic emission boosting layer on the ceramic IR-selective emissive layer by a Langmuir-Blodgett (LB) method or a spray coating.

20. A method for fabricating the radiative cooling structure of claim 13 comprising:

providing the reflective layer;

forming the ceramic IR-selectively emissive layer on the reflective layer;

forming the ceramic bonding layer on the ceramic IR-selectively emissive layer; and forming the ceramic emission boosting layer on the ceramic bonding layer by a LB method or a spray coating.

* * * * *